US010309135B2

(12) United States Patent
Okada et al.

(10) Patent No.: US 10,309,135 B2
(45) Date of Patent: Jun. 4, 2019

(54) HANDLE AND FREEZER

(71) Applicant: PHC HOLDINGS CORPORATION, Tokyo (JP)

(72) Inventors: Tadashi Okada, Saitama (JP); Eiichi Mori, Ehime (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 0 days.

(21) Appl. No.: 15/938,639

(22) Filed: Mar. 28, 2018

(65) Prior Publication Data

US 2018/0216376 A1 Aug. 2, 2018

Related U.S. Application Data

(63) Continuation of application No. PCT/JP2016/079736, filed on Oct. 6, 2016.

(30) Foreign Application Priority Data

Oct. 20, 2015 (JP) ..... 2015-206700

(51) Int. Cl.
*E05C 3/12* (2006.01)
*E05B 65/00* (2006.01)
(Continued)

(52) U.S. Cl.
CPC ..... *E05C 3/12* (2013.01); *E05B 13/108* (2013.01); *E05B 17/0025* (2013.01);
(Continued)

(58) Field of Classification Search
CPC ..... E05B 17/0025; E05B 65/0046; Y10T 292/57; Y10T 292/1041
(Continued)

(56) References Cited

U.S. PATENT DOCUMENTS 1,658,481 A * 2/1928 Ekman ..... E05C 3/145 292/241
2,212,563 A * 8/1940 Groeger ..... E05B 65/0042 292/205
(Continued)

FOREIGN PATENT DOCUMENTS

DE 9319253 U1 6/1994
JP H08-060907 A 3/1996
(Continued)

OTHER PUBLICATIONS

Extended European Search Report issued in corresponding European Patent Application No. 16857300.4-1005, dated Sep. 14, 2018.
(Continued)

*Primary Examiner* — Matthew W Ing
(74) *Attorney, Agent, or Firm* — McDermott Will & Emery LLP

(57) ABSTRACT

A handle is provided with a main unit base having an engaging pin, a door base having a rotating shaft, a knob portion, and a rotation stopper. The knob portion has an engaging groove. The engaging groove has an open end. At the door-locking position, the engaging groove and the engaging pin become engaged with each other, and at the door-unlocking position, the engagement is released. When the knob portion is located at the door-unlocking position, the rotation stopper positions the knob portion such that the engaging pin is located inside an extension range of the open end. The engaging groove has a pushing surface, which pushes the engaging pin at the time of the displacement of the knob portion.

11 Claims, 8 Drawing Sheets

(51) Int. Cl.

| | |
|---|---|
| ***F25D 23/02*** | (2006.01) |
| ***E05C 3/04*** | (2006.01) |
| ***E05B 13/10*** | (2006.01) |
| ***E05B 17/00*** | (2006.01) |

(52) U.S. Cl.
CPC ..... *E05B 65/00* (2013.01); *E05B 65/0046* (2013.01); *E05C 3/041* (2013.01); *F25D 23/02* (2013.01); *F25D 23/028* (2013.01); *E05Y 2900/306* (2013.01)

(58) Field of Classification Search
USPC ..... 312/215, 222
See application file for complete search history.

(56) References Cited

U.S. PATENT DOCUMENTS 2,256,447 A * 9/1941 Burke ..... E05B 65/0042 292/223
2,394,784 A * 2/1946 Kelly ..... B63B 43/24 292/240
2,753,204 A * 7/1956 Curtiss, Jr. ..... E05B 65/0042 292/332
4,082,077 A * 4/1978 Marfatia ..... F24C 15/022 126/197
6,543,820 B2 * 4/2003 Kelly ..... E05B 17/0025 292/341.18
7,100,951 B2 * 9/2006 Jien ..... E05B 13/002 292/207
9,101,703 B2 * 8/2015 Foerger ..... A61M 1/14
2006/0220392 A1 10/2006 Watanabe et al.

FOREIGN PATENT DOCUMENTS

JP 2006-275447 A 10/2006
KR 20110075997 A 7/2011

OTHER PUBLICATIONS

Search Report issued in corresponding International Patent Application No. PCT/JP2016/079736, dated Dec. 20, 2016.

* cited by examiner

HANDLE AND FREEZER

CROSS-REFERENCE TO RELATED APPLICATIONS

This application is based upon and claims the benefit of priority from the prior Japanese Patent Application No. 2015-206700, filed on Oct. 20, 2015, and International Patent Application No. PCT/JP2016/079736, filed on Oct. 6, 2016, the entire content of each of which is incorporated herein by reference.

BACKGROUND

Field of the Invention

The present invention relates to a handle and a freezer provided with this handle.

Description of the Related Art

In the related art, a handle is known that is used for opening and closing a door of a freezer having a storage compartment inside which is cooled to an extremely low temperature of −80 degrees Celsius or below (e.g., see Patent document 1). This handle has a structure where the closed state of the door is maintained by the engagement of a latch receiver provided on the side of a freezer main unit with a latch part provided on the side of the door. The engagement of the latch receiver and the latch part and the release of the engagement are switched by the rotation of a knob portion.

Patent document 1: JP 2006-275447

The present inventors have made intensive study on the above-stated handle for a freezer and found out that there is room for improvement in related-art handles in terms of improving the user-friendliness of a freezer.

SUMMARY OF THE INVENTION

In this background, a purpose of the present application is to provide a technology for improving the user-friendliness of a freezer.

To solve the problem above, one embodiment of the present application relates to a handle. The handle for a freezer provided with a freezer main unit that has an opening at a front surface thereof and a door that is rotatably connected to the freezer main unit at one end side in the horizontal direction and seals the opening in an openable and closable manner by rotating around an axis in the vertical direction, comprises: a main unit base that is fixed to a side surface of the freezer main unit on the side where the freezer main unit and the door are not connected and that has an engaging pin extending in the horizontal direction; a door base that is fixed to a side surface of the door on the side where the freezer main unit and the door are not connected and that has a rotating shaft extending in the horizontal direction; a knob portion that is displaceable, by rotating around the rotating shaft, between a door-locking position where the opening and closing of the door is restricted and a door-unlocking position where the opening and closing of the door is allowed; and a rotation stopper that determines the door-unlocking position of the knob portion. The knob portion has an engaging groove in which the engaging pin moves due to the rotation of the knob portion, the engaging groove has an open end that faces in the horizontal direction when the knob portion is located at the door-unlocking position and through which the engaging pin is retracted or enters due to the opening or closing of the door, the engaging groove and the engaging pin become engaged with each other restricting the opening and closing of the door when the knob portion is displaced from the door-unlocking position to the door-locking position, and the engagement of the engaging groove and the engaging pin is released allowing for the opening and closing of the door when the knob portion is displaced from the door-locking position to the door-unlocking position. When the knob portion is located at the door-unlocking position, the rotation stopper positions the knob portion such that the engaging pin is located inside an extension range of the open end in the vertical direction. The engaging groove has a pushing surface that pushes, when the knob portion is displaced from the door-locking position to the door-unlocking position, the engaging pin such that the horizontal direction distance between the engaging pin and the rotating shaft obtained when the knob portion is located at the door-unlocking position becomes larger than the horizontal direction distance between the engaging pin and the rotating shaft obtained when the knob portion is located at the door-locking position.

Another embodiment of the present application relates to a freezer. The freezer comprises: a freezer main unit that has an opening; a door that seals the opening in an openable and closable manner; and the handle according to the above embodiment.

BRIEF DESCRIPTION OF DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
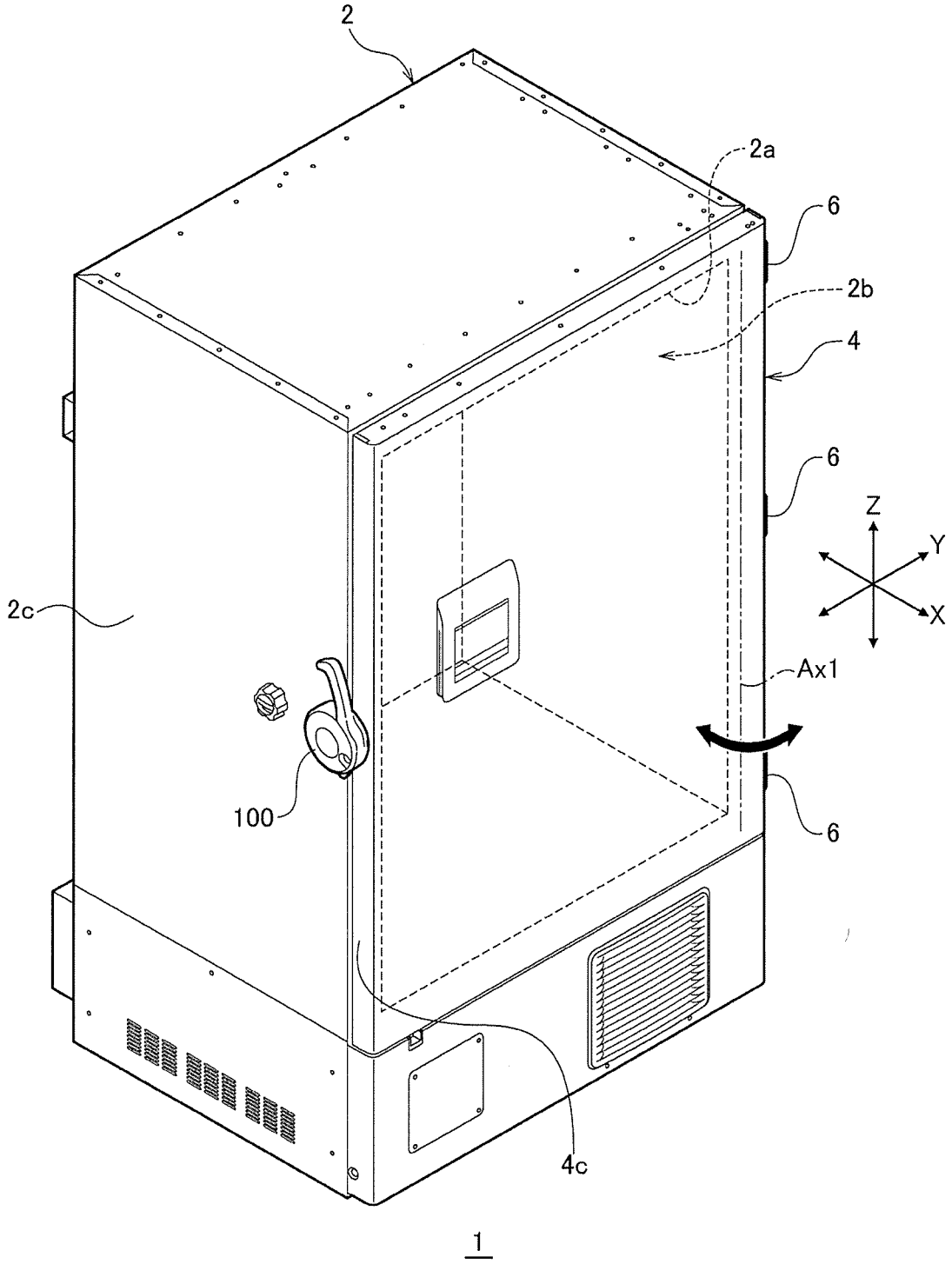
FIG. 1 is a perspective view of a freezer according to an embodiment.

A description will be given of an embodiment of the present invention with reference to the drawings. The same or equivalent constituting elements, members, and processes illustrated in each drawing shall be denoted by the same reference numerals, and duplicative explanations will be omitted appropriately. Reference herein to details of the illustrated embodiments is not intended to limit the scope of the claims. It should be understood that not all of the features and the combination thereof discussed are essential to the invention. Some of the members not important for the purpose of describing the embodiments are not shown in the drawings.

FIG. 1 is a perspective view of a freezer according to an embodiment. A freezer 1 according to the present embodiment is a freezing machine that can cool the inside of a storage compartment to an extremely low temperature of approximately −80 degrees Celsius. The freezer 1 is provided with a freezer main unit 2, a door 4, and a handle 100. The freezer main unit 2 is a vertical heat insulating box and has an opening 2*a* at a front surface thereof and a storage compartment 2*b* inside thereof. The storage compartment 2*b* communicates with the outside via the opening 2*a*. The door 4 is rotatably connected to the freezer main unit 2 at one end side in the horizontal direction (a direction shown by an arrow Y in FIG. 1). For example, the door 4 is rotatably connected to the freezer main unit 2 via a hinge mechanism 6, which is conventionally known. The door 4 seals the opening 2*a* in an openable and closable manner by rotating around an axis Ax1 in the vertical direction.

The handle 100 is provided on respective side surfaces 2*c* and 4*c* on the side where the freezer main unit 2 and the door 4 are not connected, that is, on a side surface of the freezer 1 on the side that is opposite to the side the hinge mechanism 6 is provided. In the present embodiment, the hinge mechanism 6 is provided on a right side surface viewed from the front of the freezer 1, and the handle 100 is provided on a left side surface. The attachment position of the hinge mechanism 6 and the attachment position of the handle 100 may be switched. The handle 100 is operated at the time of opening/closing the door 4. A detailed explanation will be given regarding the structure of the handle 100 in the following.

Figure 2:
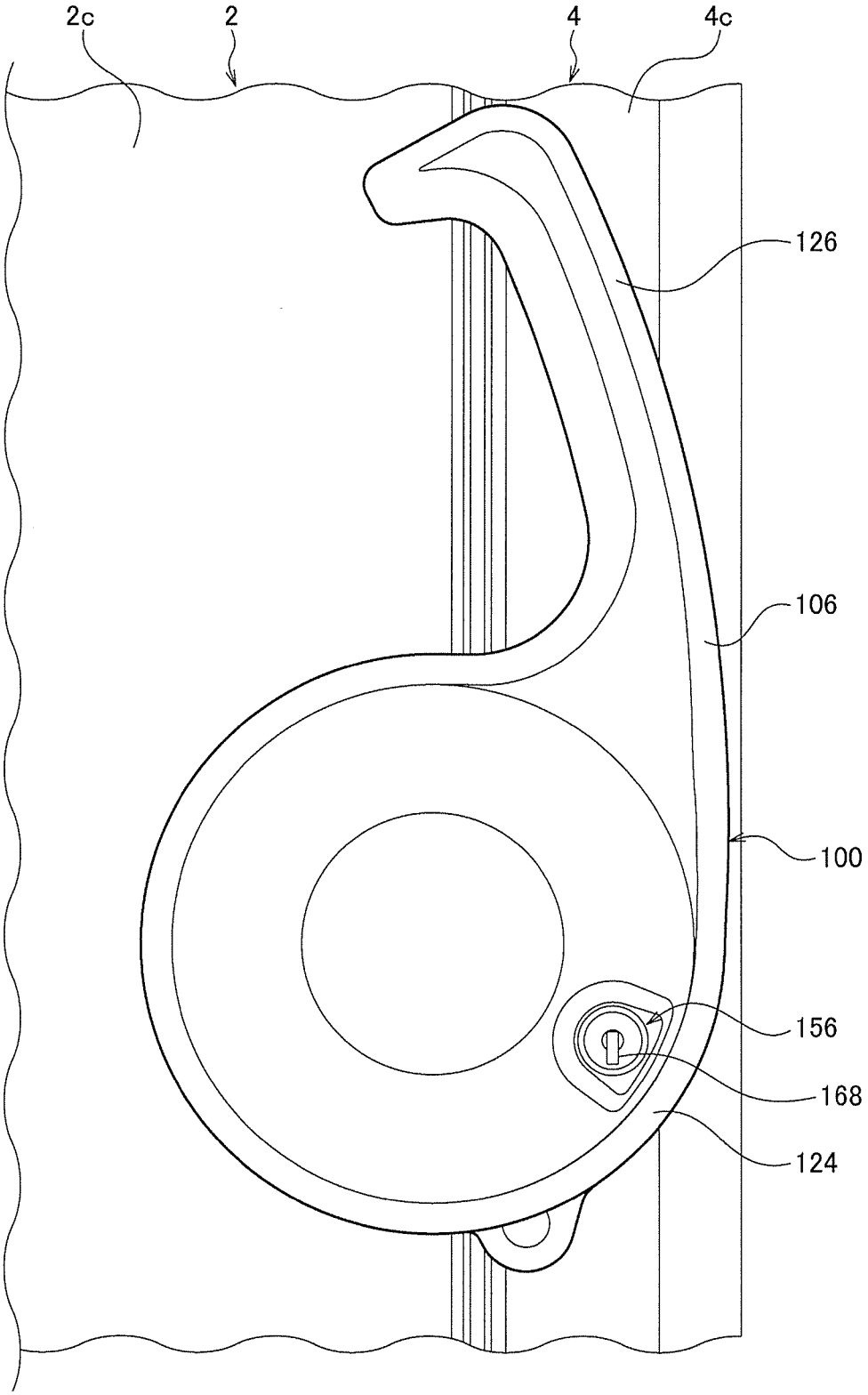
FIG. 2 is a front view of a handle according to the embodiment.
Figure 3:
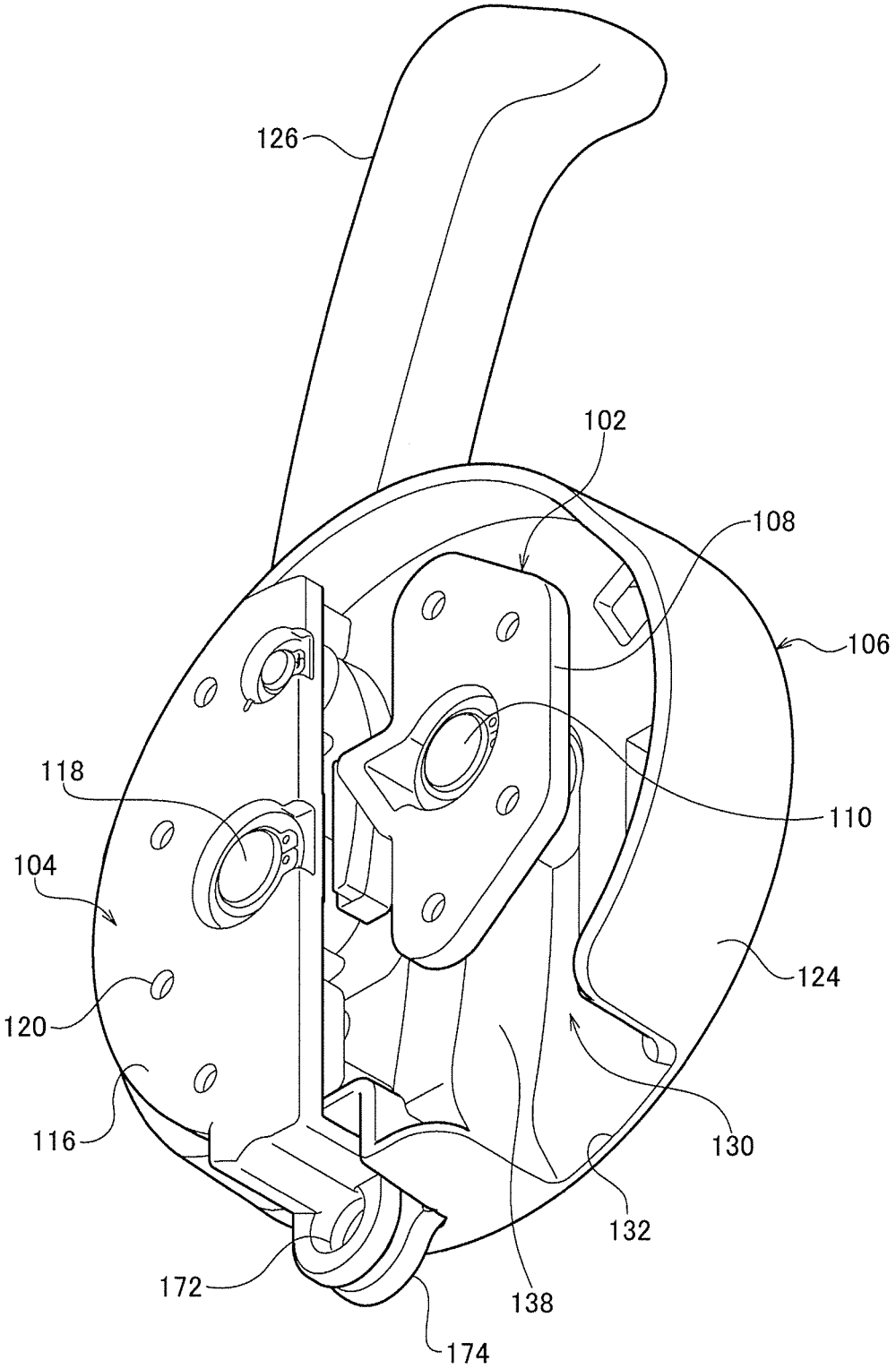
FIG. 3 is a perspective view of the handle viewed from the lower side of the back surface of the handle.
Figure 4:
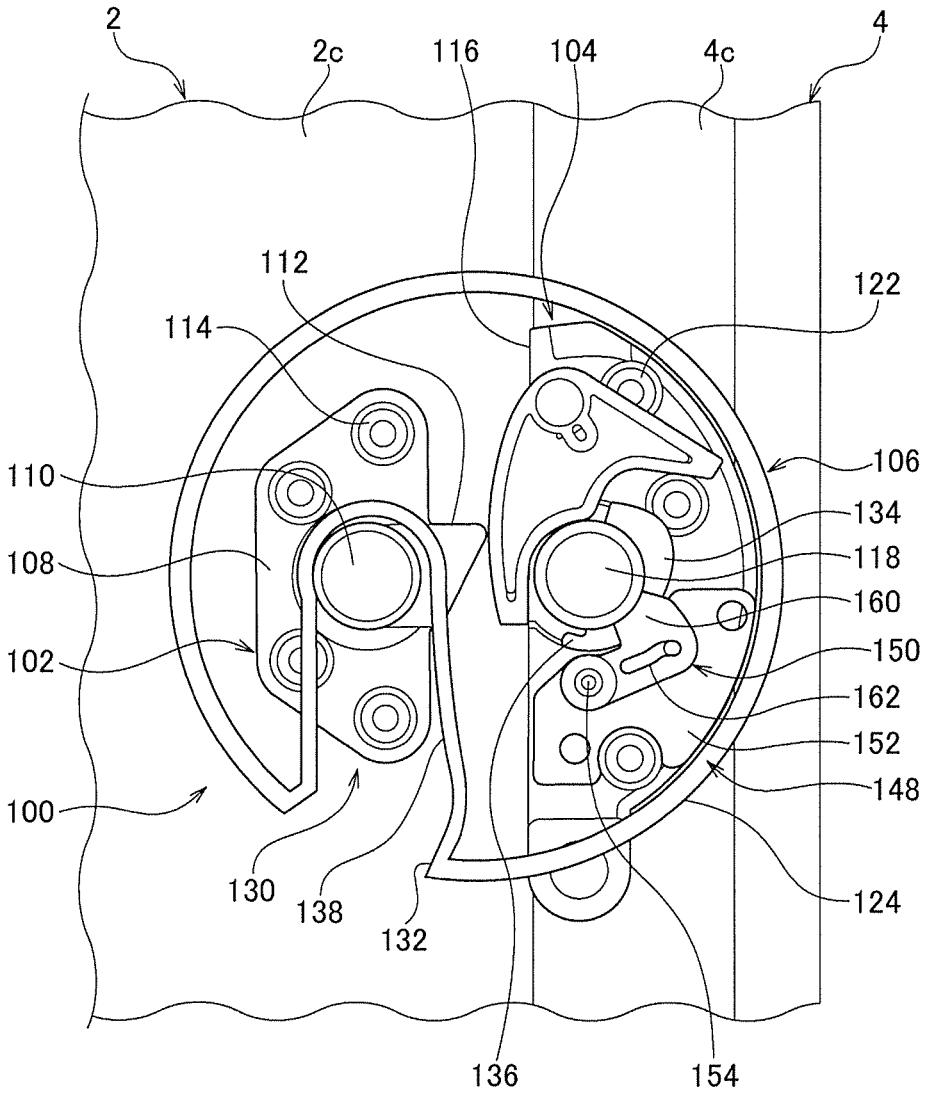
FIG. 4 is a diagram showing the internal structure of the handle.
Figure 5:
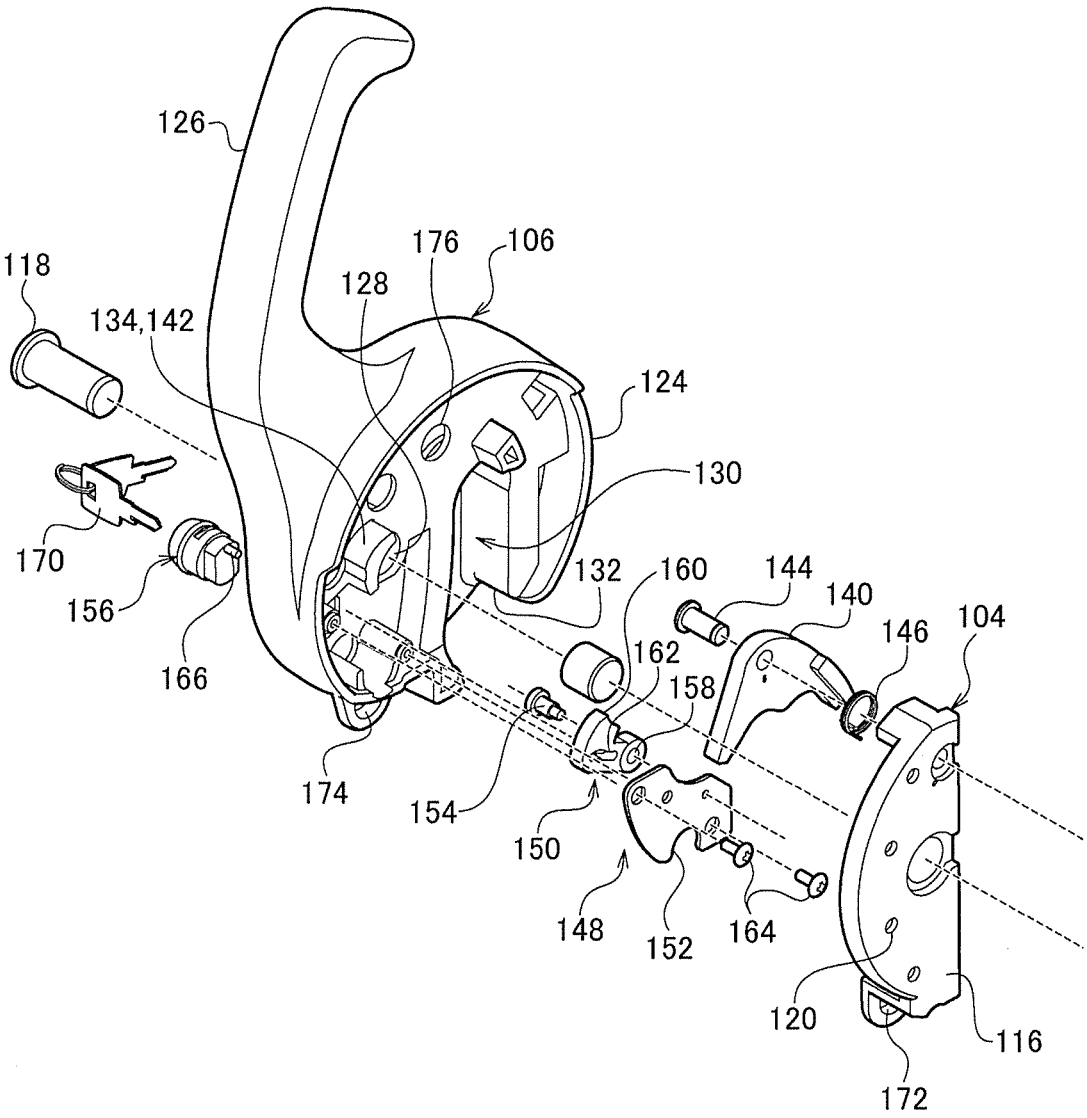
FIG. 5 is an exploded perspective view of the handle.

FIG. 2 is a front view of the handle 100 according to the embodiment. FIG. 3 is a perspective view of the handle 100 viewed from the lower side of the back surface of the handle 100. FIG. 4 is a diagram showing the internal structure of the handle 100. FIG. 5 is an exploded perspective view of the handle 100. For the sake of convenience, the direction in which the side surfaces of the freezer 1 are lined up (a direction shown by an arrow Y in FIG. 1) is referred to as a front-back surface direction of the handle 100. Further, the side of the handle 100 that comes into contact with a side surface of the freezer 1 is a back surface of the handle 100. Also, in FIG. 5, the schematic illustration of a main unit base is omitted.

The handle 100 for the freezer 1 is provided with a main unit base 102, a door base 104, and a knob portion 106. The main unit base 102 is fixed to the freezer main unit 2. The door base 104 is fixed to the door 4. The knob portion 106 is connected to the door base 104.

The main unit base 102 is fixed to the side surface 2*c* of the freezer main unit 2 on the side where the freezer main unit 2 and the door 4 are not connected. The main unit base 102 has a flat plate portion 108, an engaging pin 110, and a projecting portion 112. One of main surfaces of the flat plate portion 108 abuts on the side surface 2*c* of the freezer main unit 2, and the flat plate portion 108 is fixed to the freezer main unit 2 by a fastening member 114 such as a screw. The engaging pin 110 extends in the horizontal direction (in the direction shown by the arrow Y in FIG. 1, in other words, substantially the normal line direction of the side surface 2*c*) while being fixed to the flat plate portion 108. The projecting portion 112 is formed integrally with the flat plate portion 108 and projects to the side of the knob portion 106, more specifically, to the side of a restricting member 140 of the knob portion 106 or to the side of the door base 104. In the present embodiment, the projecting portion 112 projects more toward the side of the knob portion 106 than the engaging pin 110 and further toward the side of the knob portion 106 than the flat plate portion 108. The main unit base 102 is formed mainly of a metal material.

The door base 104 is fixed to the side surface 4*c* of the door 4 on the side where the freezer main unit 2 and the door 4 are not connected. The door base 104 has a flat plate portion 116 and a rotating shaft 118. One of main surfaces of the flat plate portion 116 abuts on the side surface 4*c* of the door 4. A first insertion hole 120 is provided on the flat plate portion 116. By the insertion of a fastening member 122 such as a screw into the first insertion hole 120, the door base 104 is fixed to the door 4. The rotating shaft 118 extends in the horizontal direction (in the direction shown by the arrow Y in FIG. 1, in other words, substantially the normal line direction of the side surface 4*c*) while being fixed to the flat plate portion 116. The door base 104 is formed mainly of a metal material.

The knob portion 106 is rotatably connected to the rotating shaft 118. The knob portion 106 has a cover portion 124, which has a hollow structure for covering the main unit base 102 and the door base 104, and a grip portion 126, which extends upward from the cover portion 124 in the vertical direction (in the direction shown by an arrow Z in FIG. 1). The cover portion 124 has a bottomed cylindrical shape, and the grip portion 126 is provided on the outer circumference of the cover portion 124. The cover portion 124 is arranged such that an open end of the cylinder faces the freezer 1. The cover portion 124 has an insertion hole 128 for the rotating shaft 118 at the bottom surface of the cylinder. By the insertion of the rotating shaft 118 into the insertion hole 128, the knob portion 106 is rotatably connected to the door base 104. The knob portion 106 is formed mainly of a resin material.

Figure 7A:
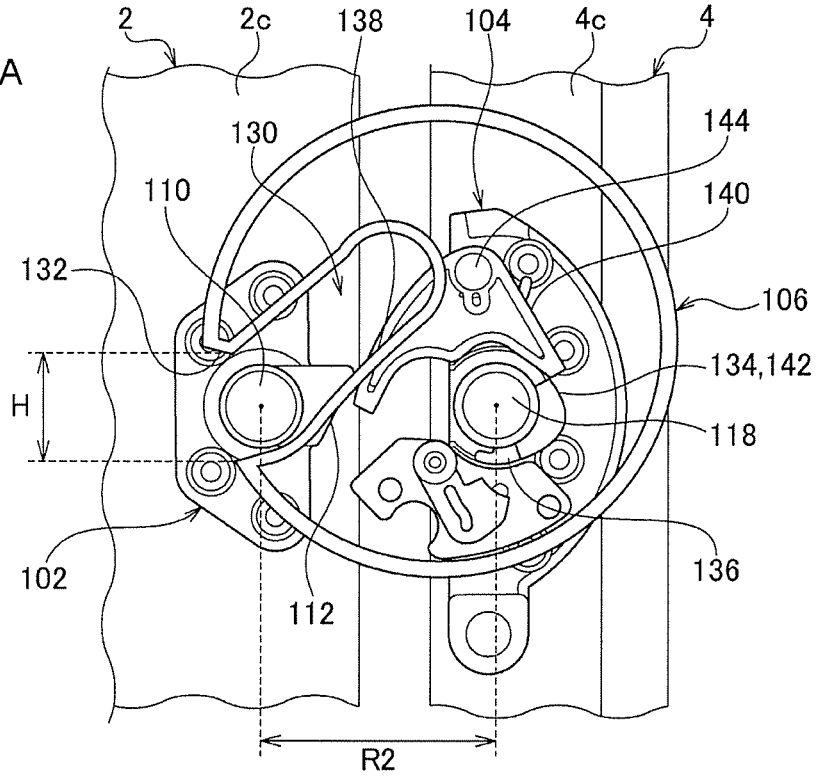
FIG. 7A and FIG. 7B are diagrams showing the internal structure of the handle at respective rotating positions of the knob portion.

The knob portion 106 is displaceable, by rotating around the rotating shaft 118, between a door-locking position where the opening and closing of the door 4 is restricted and a door-unlocking position where the opening and closing of the door 4 is allowed. FIG. 4 graphically illustrates the knob portion 106 located at the door-locking position. FIG. 7A, which is described later, graphically illustrates the knob portion 106 located at the door-unlocking position. A user of the freezer 1 can displace the knob portion 106 between the door-locking position and the door-unlocking position by the pushing and pulling of the grip portion 126 in the front-back surface direction (in the direction shown by an arrow X in FIG. 1) of the freezer 1.

The knob portion 106 has an engaging groove 130 inside the cover portion 124. The engaging groove 130 extends in the vertical direction in a state where the knob portion 106 is located at the door-locking position. The engaging groove 130 has an open end 132. The open end 132 corresponds to a portion of the outer circumference of the cover portion 124 that has been cut out in a region where the outer circumference of the cover portion 124 and the engaging groove 130 come into contact with each other. The engaging pin 110 can enter or become retracted from the engaging groove 130 via the open end 132. The engaging pin 110 that has entered the engaging groove 130 moves inside the engaging groove 130 due to the rotation of the knob portion 106.

Further, on the cover portion 124, a convex portion 134 projecting to the side of the door base 104 is provided at a peripheral portion of the insertion hole 128. On the other hand, on the door base 104, a rotation stopper 136 projecting to the side of the cover portion 124 is provided at a peripheral portion of the rotating shaft 118. The convex portion 134 and the rotation stopper 136 are displaced in a relative manner due to the rotation of the knob portion 106 and abut on each other when the knob portion 106 is located at the door-unlocking position. Therefore, the convex portion 134 and the rotation stopper 136 function as positioning members that determine the door-unlocking position of the knob portion 106.

An explanation will be given here regarding the operation of the handle 100 with reference to FIGS. 6A, 6B, 7A, and 7B. FIGS. 6A, 6B, 7A, and 7B are diagrams showing the internal structure of the handle 100 at respective rotating positions of the knob portion 106.

Figure 6A:
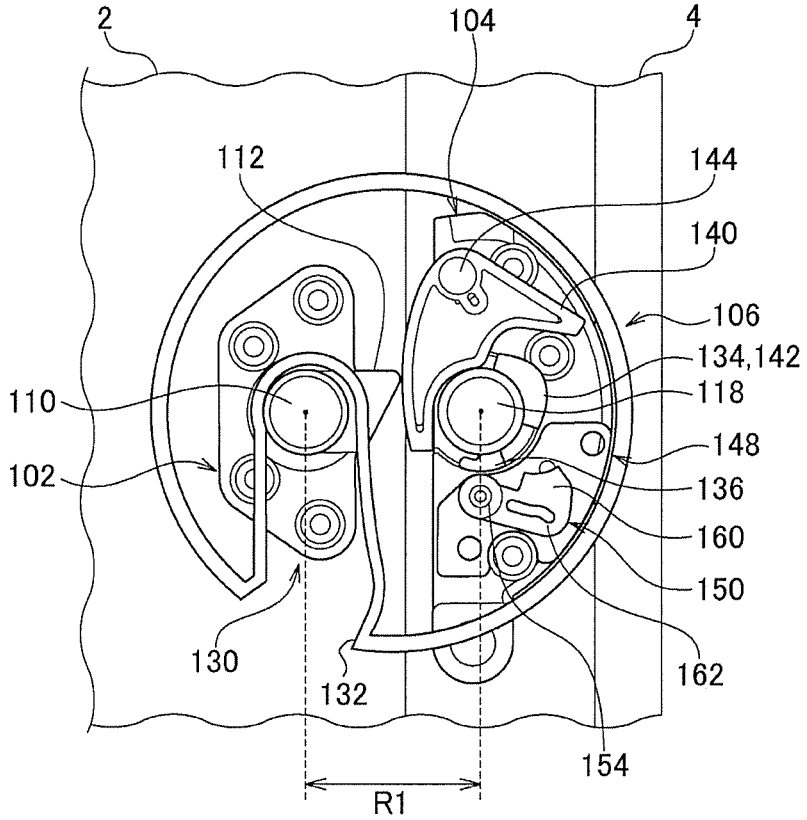
FIG. 6A and FIG. 6B are diagrams showing the internal structure of the handle at respective rotating positions of a knob portion.
Figure 7B:
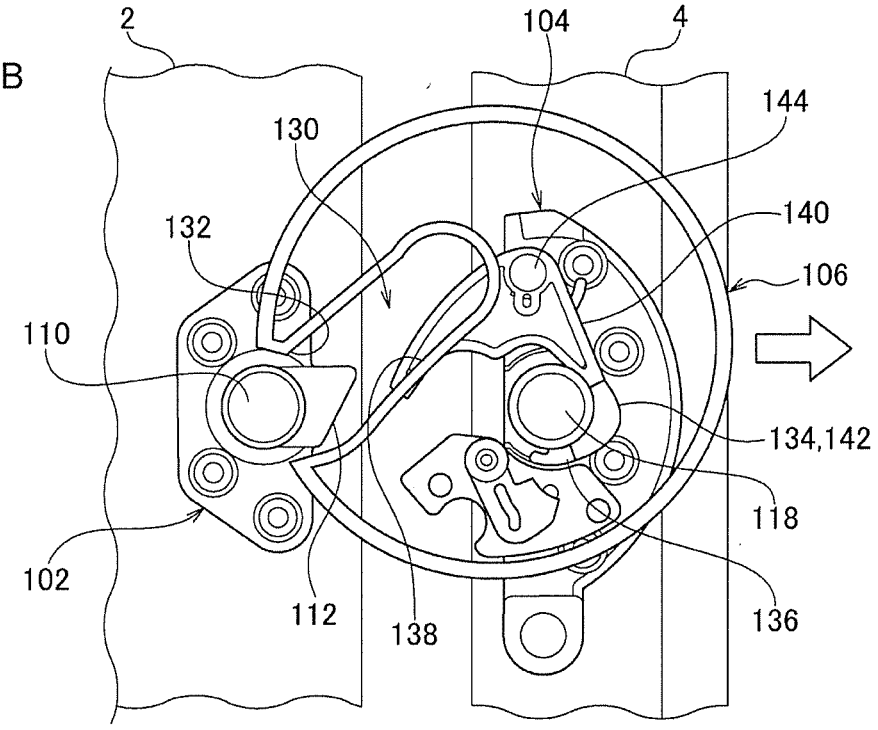

The knob portion 106 can rotate between the door-locking position shown in FIG. 6A and the door-unlocking position shown in FIGS. 7A and 7B. As shown in FIG. 6A, when the knob portion 106 is located at the door-locking position, the engaging pin 110 is located inside the engaging groove 130, and the engaging pin 110 and the engaging groove 130 are engaged with each other. The engaging pin 110 enters all the way to the innermost part of the engaging groove 130. Since the engaging pin 110 and the engaging groove 130 are engaged with each other, the opening and closing of the door 4 is restricted. The open end 132 faces downward in the vertical direction in a state where the knob portion 106 is located at the door-locking position.

Figure 6B:
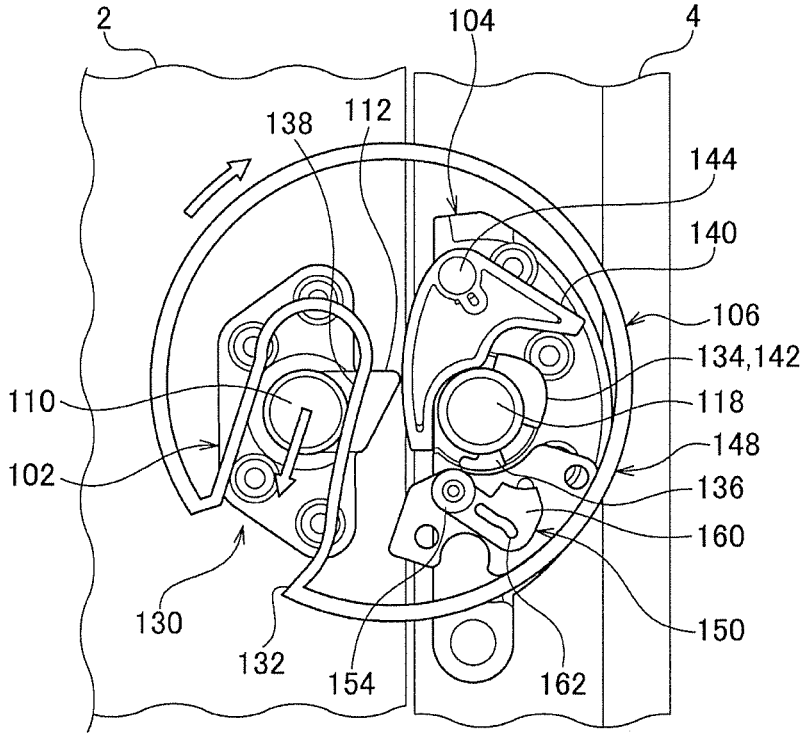

As shown in FIG. 6B, when the knob portion 106 rotates around the rotating shaft 118, the engaging pin 110 moves inside the engaging groove 130 toward the open end 132. The engaging pin 110 moves while abutting on a pushing surface 138, which is the side surface of the engaging groove 130 and located between the engaging pin 110 and the rotating shaft 118, at this time. The pushing surface 138 has a convex curved surface shape on the engaging pin 110 side. For example, the pushing surface 138 is formed of a portion of an ellipse centered at the rotating shaft 118. Therefore, the pushing surface 138 pushes the engaging pin 110 in a direction in which the freezer main unit 2 and the door 4 become spaced apart from each other (in a direction shown by an arrow X in FIG. 1) when the knob portion 106 is displaced from the door-locking position to the door-unlocking position. Also, as the knob portion 106 rotates, the convex portion 134 approaches the rotation stopper 136.

As shown in FIG. 7A, the knob portion 106 rotates until the convex portion 134 abuts on the rotation stopper 136. The position at which the convex portion 134 abuts on the rotation stopper 136 is the door-unlocking position of the knob portion 106. The open end 132 faces in the horizontal direction (the direction shown by the arrow X in FIG. 1, more specifically, the back surface direction of the freezer 1) when the knob portion 106 is located at the door-unlocking position. When the knob portion 106 is located at the door-unlocking position, the rotation stopper 136 positions the knob portion 106 such that the engaging pin 110 is located inside an extension range H of the open end 132 in the vertical direction. This releases the engagement of the engaging pin 110 and the engaging groove 130 and allows the opening and closing of the door 4.

The engaging pin 110 moves inside the engaging groove 130 while being pushed by the pushing surface 138 in accordance with the rotation of the knob portion 106 and reaches the vicinity of the open end 132 of the engaging groove 130. Due to the engaging pin 110 being pushed by the pushing surface 138, a horizontal direction distance R2 between the engaging pin 110 and the rotating shaft 118 obtained when the knob portion 106 is located at the door-unlocking position becomes larger than a horizontal direction distance R1 between the engaging pin 110 and the rotating shaft 118 obtained when the knob portion 106 is located at the door-locking position (see FIG. 6A). In the present embodiment, when the engaging pin 110 is pushed by the pushing surface 138, the freezer main unit 2 and the door 4 no longer come into contact with each other on the side of the side surfaces 2C and 4C on which the main unit base 102 and the door base 104 are fixed, respectively.

In the present embodiment, when a sealing member such as a packing material is provided at a peripheral portion of a main surface of the door 4 that faces the side of the freezer main unit 2, the sealing member is also included in the "door". Therefore, the state, "the freezer main unit 2 and the door 4 no longer come into contact with each other", means a state where the freezer main unit 2 and the sealing member provided on the door 4 are spaced apart from each other. The same applies to a case where a sealing member is provided on the outer circumference of the opening 2*a* of the freezer main unit 2.

When the knob portion 106 is located at the door-unlocking position, the engaging pin 110 is located inside the extension range H of the open end 132 in the vertical direction. Therefore, as shown in FIG. 7B, the door 4 can be opened by allowing the door 4 to rotate around an axis Ax1 (see FIG. 1). Due to the opening operation of the door 4, the engaging pin 110 is retracted from the engaging groove 130. When the door 4 is closed, the opposite operation is performed. In other words, in a state where the knob portion 106 is located at the door-unlocking position, the engaging pin 110 enters the engaging groove 130 due to the closing operation of the door 4. When the knob portion 106 rotates around the rotating shaft 118, the engaging pin 110 moves inside the engaging groove 130 and reaches the innermost part. As a result, the knob portion 106 is displaced from the door-unlocking position to the door-locking position.

Therefore, in the handle 100, when the knob portion 106 is displaced from the door-unlocking position to the door-locking position, the engaging groove 130 and the engaging pin 110 become engaged with each other restricting the opening and closing of the door 4, and when the knob portion 106 is displaced from the door-locking position to the door-unlocking position, the engagement of the engaging groove 130 with the engaging pin 110 is released allowing for the opening and closing of the door 4.

The center of gravity is set for the knob portion 106 such that load is applied in a direction of rotation around the rotating shaft 118 in a counter-clockwise direction at the door-locking position shown in FIG. 6A. In other words, in a state where external load is not applied to the knob portion 106, load is applied to the knob portion 106 in a direction in which the engaging pin 110 moves inside the engaging groove 130 to the side opposite from the open end 132. This prevents unintentional rotation of the knob portion 106 in a situation where external load is not applied to the knob portion 106 and prevents the engaging pin 110 from being located on the open end 132 side of the engaging groove 130. As a result, a situation can be prevented where the knob portion 106 is unintentionally displaced to the door-unlocking position thereby opening the door 4. For example, in the freezer 1 shown in FIG. 1, the opening 2*a* of the freezer main unit 2 is covered by the door 4. Further, in order to maintain the airtightness of the storage compartment 2*b*, an elastic packing material is provided between the freezer main unit 2 and the door 4. The door 4 seals the opening 2*a* of the freezer main unit 2 while pushing this packing material. Therefore, force in a direction away from the freezer main unit 2 is applied to the door 4 due to repulsive force of the packing material. For this reason, in a state where the knob portion 106 is located at the door locking position, the side surface on the freezer main unit 2 side in the engaging groove 130 and the engaging pin 110 are engaged with each other with predetermined engaging force caused by the repulsive force of the packing material. On the other hand, when the pressure inside the storage compartment 2*b* is decreased due to cooling or the like inside the storage compartment 2*b*, the door 4 may be pushed onto the freezer main unit 2 side. In this case, the engaging force between the engaging pin 110 and the engaging groove 130 caused by the repulsive force of the packing material may be weakened. Even in such a case, by setting the center of gravity of the knob portion 106 as described above, a situation can be prevented where the knob portion 106 is unintentionally displaced to the door-unlocking position thereby opening the door 4.

[Handle Returning Locking Mechanism]

An explanation will be given regarding a handle returning locking mechanism of the handle 100 with reference to FIGS. 5, 7A, and 7B. The handle returning locking mechanism is a mechanism for restricting the displacement of the knob portion 106 located at the door-unlocking position to the door locking position.

One of the knob portion 106 and the door base 104 has a restricting member 140, and the other has a restricting member receiving portion 142. In the present embodiment, the knob portion 106 has the restricting member receiving portion 142, and the door base 104 has the restricting member 140. Also, the convex portion 134 provided on the knob portion 106 functions as the restricting member receiving portion 142. In other words, the convex portion 134 is used for a positioning mechanism that determines the door-unlocking position of the knob portion 106 and for the handle returning locking mechanism.

The restricting member 140 is provided in a displaceable manner with respect to one of the members (the door base 104 in the present embodiment). More specifically, the restricting member 140 is rotatably connected to the rotating shaft 144 fixed to the flat plate portion 116 of the door base 104. The restricting member 140 can be switched between a first orientation for restricting the knob portion 106 from being displaced to the door locking position by abutting on the restricting member receiving portion 142 in a state where the knob portion 106 is located at the door unlocking position (see FIG. 7B) and a second orientation for allowing the knob portion 106 located at the door unlocking position to be displaced to the door locking position by being spaced apart from the restricting member receiving portion 142 (see FIG. 7A).

Also, as shown in FIGS. 7A and 7B, the restricting member 140 is at the first orientation in a state where the engaging pin 110 is retracted from the engaging groove 130, and the orientation is switched to the second orientation when the engaging pin 110 enters the engaging groove 130. In other words, the first orientation and the second orientation of the restricting member 140 are automatically switched to each other according to the opening degree of the door 4. Then, in a state where the door 4 is open, the knob portion 106 located at the door-unlocking position is restricted from being displaced to the door locking position.

The displacement of the restricting member 140 is achieved as described in the following. In other words, as shown in FIG. 5, the handle 100 is provided with the biasing member 146, which biases the restricting member 140 to be at the first orientation. In the present embodiment, the biasing member 146 is formed of a coil spring and is fixed to the door base 104 by the insertion of the rotating shaft 144. One end of the coil spring, which forms the biasing member 146, is engaged with the door base 104, and the other end thereof is engaged with the restricting member 140. Further, as shown in FIG. 7A, the projecting portion 112 provided on the main unit base 102 is arranged at a position that has been shifted in the vertical direction from that of the rotating shaft 144 and that overlaps with the restricting member 140.

In the present embodiment, the restricting member 140 is a member having an approximately V shape. Then, the rotating shaft 144 is arranged near the vertex of the V shape. Further, one end portion of the V shape abuts on the restricting member receiving portion 142. Further, the other end portion of the V shape is pushed by the projecting portion 112. In the restricting member 140, the vertex of the V shape serves as a fulcrum, said one end portion serves as the point of load, and said the other end portion serves as the point of effort.

As shown in FIG. 7B, the projecting portion 112 and the restricting member 140 are spaced apart from each other in a state where the engaging pin 110 is retracted from the engaging groove 130. Therefore, the restricting member 140 is at the first orientation due to the biasing force of the biasing member 146. At the first orientation, said one end portion of the restricting member 140 moves onto the trajectory of the restricting member receiving portion 142, which is displaced according to the rotation of the knob portion 106, and abuts on the restricting member receiving portion 142. On the other hand, when the door 4 moves closer to the freezer main unit 2 so that the engaging pin 110 enters the engaging groove 130, the projecting portion 112 pushes the restricting member 140 in a direction that is opposite to the biasing direction of the biasing member 146 in accordance with the approaching of the door 4 to the freezer main unit 2. Thereby, the orientation of the restricting member 140 is switched to the second orientation. Due to said other end portion being pushed by the projecting portion 112, the restricting member 140 rotates using the vertex of the V shape as a fulcrum, and said one end portion is retracted from the trajectory of the restricting member receiving portion 142.

In the process of the knob portion 106 rotating so as to be displaced to the door-locking position, the door 4 and the freezer main unit 2 gradually approach each other. Therefore, as shown in FIGS. 6A and 6B, the restricting member 140 continues to be pushed by the projecting portion 112 and maintains the second orientation.

[First Security Mechanism]

An explanation will be given regarding a first security mechanism with reference to FIG. 2 and FIGS. 4 to 6B. The first security mechanism is a mechanism for preventing the door 4 from opening by restricting the rotation of the knob portion 106 located at the door-locking position.

The handle 100 has a lock mechanism 148, which fixes the knob portion 106 to the door base 104. The lock mechanism 148 has a convex portion 134, a lock pin 150, a fixing base 152, a rotating shaft 154, and a lock pin rotating portion 156. The convex portion 134 rotates along with the knob portion 106 and abuts on the rotation stopper 136 when the knob portion 106 is located at the door-unlocking position (see FIG. 7A) and becomes spaced apart from the rotation stopper 136 when the knob portion 106 is located at the door-locking position (see FIG. 6A).

The lock pin 150 is a member that is long in one direction, has an insertion hole 158 on one end side, has a head portion 160 on the other end side, and has an engaging slit 162 at an intermediate portion thereof. The head portion 160 projects in a direction that intersects with the extending direction of the lock pin 150. The engaging slit 162 extends roughly along the extending direction of the lock pin 150. By the insertion of the rotating shaft 154 into the insertion hole 158, the lock pin 150 is rotatably connected to the rotating shaft 154. The rotating shaft 154 is fixed to the fixing base 152. The fixing base 152 is fixed to the knob portion 106 by a fastening member 164 such as a screw.

The lock pin rotating portion 156 is an approximately cylindrical member and is provided so as to penetrate the cover portion 124. The lock pin rotating portion 156 has an engaging projection 166 on the side of one end that is arranged inside the cover portion 124 and has a key hole 168 on the side of the other end that is exposed outside the cover portion 124. The engaging projection 166 of the lock pin rotating portion 156 is inserted into the engaging slit 162 of the lock pin 150. By inserting a key 170 into the key hole 168 and then rotating the key 170, the lock pin rotating portion 156 can be rotated. The rotation of the lock pin rotating portion 156 is transmitted to the lock pin 150 via the engaging projection 166 and the engaging slit 162, and the lock pin 150 rotates around the rotating shaft 154.

As shown in FIG. 4, the lock pin 150 allows the head portion 160 to enter a space between the convex portion 134 and the rotation stopper 136 that is created in a state where the knob portion 106 is located at the door-locking position. The entry of the head portion 160 to the space between the convex portion 134 and the rotation stopper 136 restricts the displacement of the convex portion 134 to a direction where the convex portion 134 approaches the rotation stopper 136. Therefore, the displacement of the knob portion 106 from the door-locking position to the door-unlocking position is restricted.

When a user rotates the lock pin rotating portion 156 using the key 170, the lock pin 150 rotates around the rotating shaft 154 as shown in FIG. 6A. Then, the head portion 160 is retracted from the space between the convex portion 134 and the rotation stopper 136. This allows the convex portion 134 to be displaced in the direction where the convex portion 134 approaches the rotation stopper 136 as shown in FIG. 6B. In other words, the knob portion 106 can be displaced from the door-locking position to the door-unlocking position.

[Second Security Mechanism]

An explanation will be given regarding a second security mechanism with reference to FIG. 3 and FIG. 5. The second security mechanism is a mechanism for preventing the door 4 from opening by locking the handle 100 using a lock such as a padlock.

The door base 104 has a first lock hole 172 in which a lock (not shown) for fixing the knob portion 106 to the door base 104 is mounted. Also, the knob portion 106 has a second lock hole 174 in which a lock is mounted together with the first lock hole 172.

The positional relationship of the first lock hole 172 and the second lock hole 174 is defined such that, in a direction where the door base 104 and the knob portion 106 are lined up (in the direction shown by the arrow Y in FIG. 1), the first lock hole 172 and the second lock hole 174 overlap with each other when the knob portion 106 is located at the door-locking position and are shifted from each other when the knob portion 106 is located at the door-unlocking position. In a state where the first lock hole 172 and the second lock hole 174 overlap with each other, that is, in a state where the knob portion 106 is located at the door-locking position, the latch of the lock is inserted into the second lock hole 174 after the first lock hole 172 or inserted into the first lock hole 172 after the second lock hole 174 so as to achieve locking. Thereby, the displacement of the knob portion 106 from the door-locking position to the door-unlocking position is restricted.

[Third Security Mechanism]

Figure 8A:
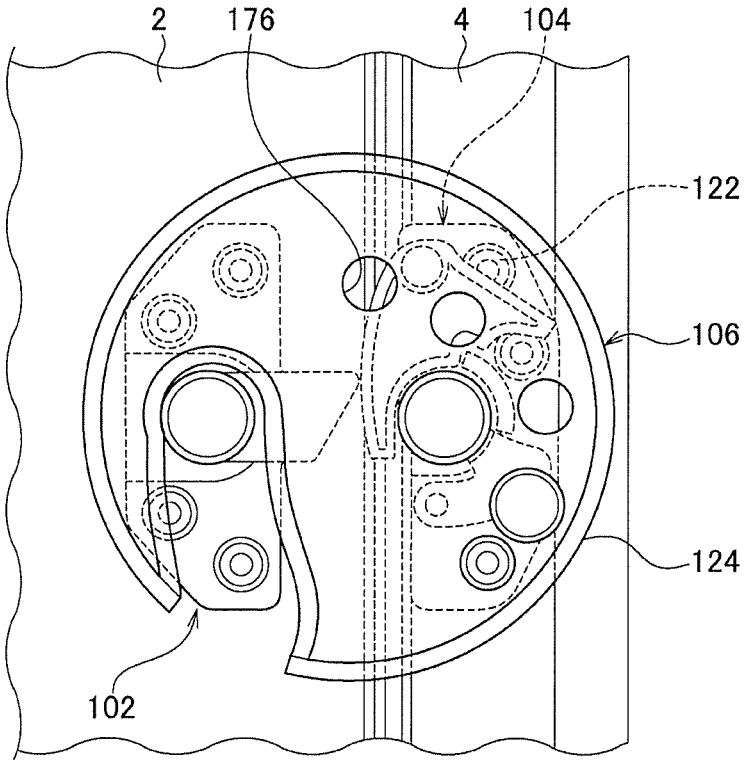
FIG. 8A and FIG. 8B are diagrams for explaining a third security mechanism.
Figure 8B:
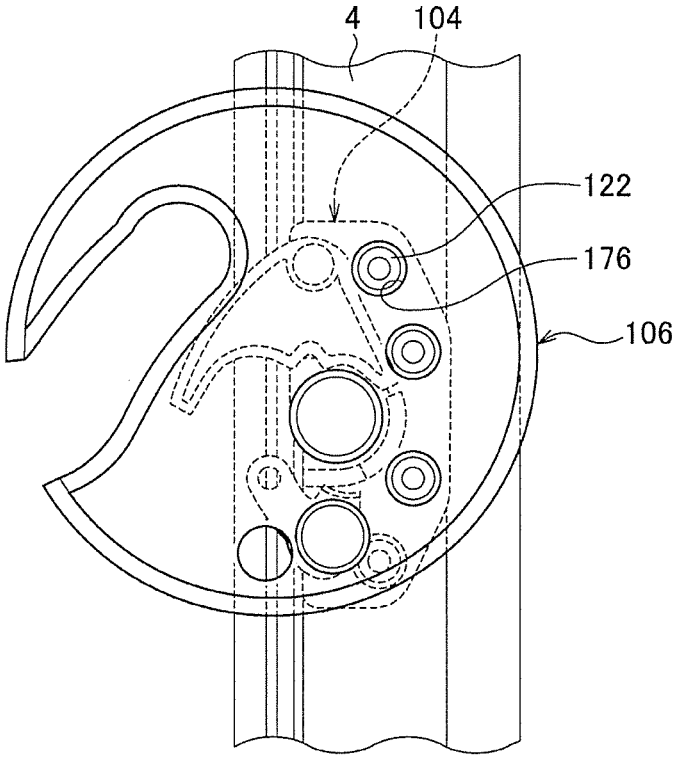

An explanation will be given regarding a third security mechanism with reference to FIGS. 8A and 8B. FIG. 8A and FIG. 8B are diagrams for explaining the third security mechanism. The third security mechanism is a mechanism for preventing the door 4 from opening by restricting the removal of the door base 104 and the knob portion 106 from the door 4.

The knob portion 106 has a second insertion hole 176 into which the fastening member 122 is inserted. The second insertion hole 176 is a hole into which the fastening member 122 is inserted when fixing the door base 104, to which the knob portion 106 is connected, to the door 4. A worker can fix the door base 104 and the knob portion 106 to the door 4 by inserting the fastening member 122 inside the cover portion 124 via the second insertion hole 176 and inserting the fastening member 122 into the first insertion hole 120 (see FIG. 3) of the door base 104.

The positional relationship of the first insertion hole 120 and the second insertion hole 176 is defined such that, in a direction where the door 4, the door base 104, and the knob portion 106 are lined up (in the direction shown by the arrow Y in FIG. 1), the first insertion hole 120 and the second insertion hole 176 overlap with each other when the knob portion 106 is located at the door-unlocking position and are shifted from each other when the knob portion 106 is located at the door-locking position. Therefore, as shown in FIG. 8A, when the knob portion 106 is located at the door-locking position, the second insertion hole 176 is shifted from the fastening member 122. Therefore, the worker cannot access the fastening member 122. On the other hand, as shown in FIG. 8B, when the knob portion 106 is located at the door-unlocking position, the worker can approach the fastening member 122 via the second insertion hole 176. Therefore, the worker can remove the fastening member 122.

In the present embodiment, four first insertion holes 120 and four second insertion holes 176 are provided, and the positional relationship of the four first insertion holes 120 and four second insertion holes 176 is defined such that, in three pairs out of the four pairs, overlapping occurs when the knob portion 106 is located at the door-unlocking position and shifting from each other occurs when the knob portion 106 is located at the door-locking position. On the other hand, the positional relationship is defined such that, in the remaining pair located at the lowermost end, overlapping occurs when the knob portion 106 is located at the door-locking position and shifting from each other occurs when the knob portion 106 is located at the door-unlocking position.

This is because the second insertion hole 176 cannot be provided at a position that overlaps with the first insertion hole 120 or the fastening member 122 located at the lowermost end in a state when the knob portion 106 is located at the door-unlocking position due to arrangement space circumstances. In order to provide the second insertion hole 176 at this position, the size of the knob portion 106 needs to be increased. In other words, by arranging the second insertion hole 176 that corresponds to the first insertion hole 120 located near the peripheral portion of the knob portion 106 so as to overlap with the first insertion hole 120 when the knob portion 106 is located at the door-locking position, the size of the knob portion 106 can be reduced.

Also, at least one second insertion hole 176 is arranged so that the rotating shaft 144 overlaps with a trajectory occurring when the second insertion hole 176 is displaced in accordance with the rotation of the knob portion 106. Therefore, the rotating shaft 144 can be accessed via the second insertion hole 176. Thereby, the task of removing the entire knob portion 106 or a portion of the knob portion 106 can be omitted at the time of, for example, the maintenance of the rotating shaft 144.

As explained above, the handle 100 according to the present embodiment has the knob portion 106 displaceable between the door-locking position and the door-unlocking position. The engaging groove 130 provided in the knob portion 106 has the open end 132 facing in the horizontal direction when the knob portion 106 is located at the door-unlocking position. At the open end 132, the engaging pin 110 becomes retracted from or enters by the opening and closing of the door 4. When the knob portion 106 is displaced from the door-unlocking position to the door-locking position, the engaging groove 130 and the engaging pin 110 become engaged with each other, and the handle 100 thus restricts the opening and closing of the door 4. Also, when the knob portion 106 is displaced from the door-locking position to the door-unlocking position, the engagement of the engaging groove 130 and the engaging pin 110 is released, and the handle 100 thus allows for the opening and closing of the door 4.

The handle 100 is provided with the rotation stopper 136, which determines the door-unlocking position of the knob portion 106. When the knob portion 106 is located at the door-unlocking position, the rotation stopper 136 positions the knob portion 106 such that the engaging pin 110 is located inside the extension range H of the open end 132 in the vertical direction. Thereby, a user can open and close the door 4 without fine positional adjustment of the engaging pin 110 and the open end 132 at the time of the opening and closing of the door 4. Therefore, the user-friendliness of the freezer 1 can be improved. Particularly when the door 4 is closed, the engaging pin 110 can smoothly and surely enter inside the engaging groove 130 from the open end 132. Therefore, damage caused by the collision of the engaging pin 110 and the knob portion 106 can be prevented.

Further, the engaging groove 130 has the pushing surface 138. When the knob portion 106 is displaced from the door-locking position to the door-unlocking position, the pushing surface 138 pushes the engaging pin 110 such that the horizontal direction distance R2 between the engaging pin 110 and the rotating shaft 118 obtained when the knob portion 106 is located at the door-unlocking position becomes larger than the horizontal direction distance R1 between the engaging pin 110 and the rotating shaft 118 obtained when the knob portion 106 is located at the door-locking position.

The inside of the storage compartment 2*b* of the freezer 1 is sealed from the outside and maintained at a low temperature. Therefore, the inside of the storage compartment 2*b* is likely to become negatively pressurized. Also, in general, a magnet packing material is interposed between the freezer main unit 2 and the door 4. Also, in some cases, frost, ice, or the like may adhere to a connecting part of the freezer main unit 2 and the door 4 Due to these factors, there are cases when the opening of the door 4 becomes difficult. Meanwhile, the handle 100 assists the opening operation of the door 4 by pushing, by the pushing surface 138, the engaging pin 110 in the direction in which the freezer main unit 2 and the door 4 become spaced apart from each other. Therefore, the force necessary for the opening operation of the door 4 can be reduced. Therefore, the user-friendliness of the freezer 1 can be improved.

Further, in the present embodiment, when the engaging pin 110 is pushed by the pushing surface 138, the freezer main unit 2 and the door 4 no longer come into contact with each other on the side of the side surfaces 2C and 4C on which the main unit base 102 and the door base 104 are fixed, respectively. Thereby, the force required for the opening operation of the door 4 can be reduced more certainly. Also, the pushing surface 138 is located between the engaging pin 110 and the rotating shaft 118 and has a convex curved surface shape on the engaging pin 110 side. Thereby, load that is produced by the pushing of the engaging pin 110 by the pushing surface 138 and that prevents the rotation of the knob portion 106 can be equalized throughout the displacement of the knob portion 106 from the door-locking position to the door-unlocking position.

The pushing surface 138 is not limited to those that have a convex curved surface shape on the engaging pin 110 side. The pushing surface 138 is only required to have a shape that allows the freezer main unit 2 and the door 4 to not come into contact with each other by pushing the engaging pin 110. For example, the pushing surface 138 has a flat surface or a curved surface that inclines so as to protrude more toward the engaging pin 110 side than a contact point of the engaging pin 110 and the pushing surface 138 in a state where the knob portion 106 is in the middle of being displaced from the door-locking position to the door-unlocking position. The shape of the pushing surface 138 itself may be a flat surface shape that extends from one end side to the other end side without bending (i.e., formed of a single flat surface) or may have a bending portion between one end side and the other end side (i.e., formed of a plurality of flat surfaces). When the pushing surface 138 has a bending portion, the pushing surface 138 may have a convex shape or a concave shape on the engaging pin 110 side, for example, in a state where the knob portion 106 is located at the door-locking position.

Further, the handle 100 is provided with the handle returning locking mechanism. In other words, one of the knob portion 106 and the door base 104 has the restricting member 140, and the other has the restricting member receiving portion 142. The restricting member 140 can be switched between the first orientation and the second orientation. The first orientation is an orientation that restricts the knob portion 106 from being displaced to the door locking position by the restricting member 140 abutting on the restricting member receiving portion 142 in a state where the knob portion 106 is located at the door-unlocking position. The second orientation is an orientation that allows the knob portion 106 located at the door-unlocking position to be displaced to the door locking position by the restricting member 140 being spaced apart from the restricting member receiving portion 142.

The handle 100 being provided with the handle returning locking mechanism can prevent a situation where, for example, the knob portion 106 goes back to the door-locking position against the user's intention while being in a state where the door 4 is open. Further, this can prevent a situation where the door 4 closes while being in a state where the knob portion 106 is back to the door-locking position causing the knob portion 106 and the engaging pin 110 to collide with each other.

Also, the restricting member 140 is at the first orientation in a state where the engaging pin 110 is retracted from the engaging groove 130, and the orientation is switched to the second orientation when the engaging pin 110 enters the engaging groove 130. In other words, the knob portion 106 is fixed such that the knob portion 106 does not go back to the door-locking position from the door-unlocking position in a state where the door 4 is open, and the fixation of the knob portion 106 is released in synchronization with the displacement of the door 4 when the door 4 closes. Therefore, the restriction of the handle rotation and the elimination of the restriction can be switched automatically in accordance with the opening degree of the door 4. Accordingly, the user-friendliness of the freezer 1 can be further improved.

Further, the handle 100 is provided with the biasing member 146, which biases the restricting member 140 to be at the first orientation. Also, the main unit base 102 has the projecting portion 112 projecting to the knob portion 106 side. The projecting portion 112 pushes the restricting member 140 in a direction that is opposite to the biasing direction of the biasing member 146 in accordance with the approaching of the door 4 to the freezer main unit 2. Thereby, the orientation of the restricting member 140 is switched to the second orientation. According to this configuration, the switching of the restriction of the handle rotation and the elimination of the restriction in accordance with the opening degree of the door 4 can be achieved by the simple configuration.

Further, the handle 100 is provided with the first security mechanism. In other words, the handle 100 has the lock mechanism 148, which fixes the knob portion 106 to the door base 104. The lock mechanism 148 has the convex portion 134 and the lock pin 150. The convex portion 134 rotates along with the knob portion 106 and abuts on the rotation stopper 136 when the knob portion 106 is located at the door-unlocking position and becomes spaced apart from the rotation stopper 136 when the knob portion 106 is located at the door-locking position. The lock pin 150 restricts the displacement of the knob portion 106 by entering a space between the convex portion 134 and the rotation stopper 136 while being in a state where the knob portion 106 is located at the door-locking position. This allows the security of the freezer 1 to be improved.

Further, the handle 100 is provided with the second security mechanism. In other words, the door base 104 has the first lock hole 172 in which a lock is mounted. The knob portion 106 has the second lock hole 174 in which a lock is mounted together with the first lock hole 172. The positional relationship of the first lock hole 172 and the second lock hole 174 is defined such that the first lock hole 172 and the second lock hole 174 overlap with each other when the knob portion 106 is located at the door-locking position and the first lock hole 172 and the second lock hole 174 are shifted from each other when the knob portion 106 is located at the door-unlocking position. This allows the security of the freezer 1 to be improved.

Further, the handle 100 is provided with the third security mechanism. In other words, the door base 104 has the flat plate portion 116, which abuts on the side surface 4*c* of the door 4, and the first insertion hole 120 into which the fastening member 122 for fixing the door base 104 to the door 4 is inserted. The knob portion 106 has the second insertion hole 176 into which the fastening member 122 is inserted. The positional relationship of the first insertion hole 120 and the second insertion hole 176 is defined such that the first insertion hole 120 and the second insertion hole 176 overlap with each other when the knob portion 106 is located at the door-unlocking position and the first insertion hole 120 and the second insertion hole 176 are shifted from each other when the knob portion 106 is located at the door-locking position. This allows the security of the freezer 1 to be improved.

The invention is not limited to the above-mentioned embodiments, and additional modifications, such as a design change, may be added thereto on the basis of knowledge of those skilled in the art. It should be understood that any embodiment to which additional modifications are added is also included in the scope of the invention. New embodiments resulting from the addition of modifications to the aforementioned embodiments will provide the advantages of the embodiments and modifications combined.

What is claimed is:

1. A handle for a freezer provided with a freezer main unit that includes a front surface having an opening, and a door that is rotatably connected to the freezer main unit at one end side in a horizontal direction and seals the opening in an openable and closable manner by rotating around an axis in a vertical direction, comprising:

a main unit base that is fixed to a side surface of the freezer main unit on the side where the freezer main unit and the door are not connected and that has an engaging pin extending in the horizontal direction;

a door base that is fixed to a side surface of the door on the side where the freezer main unit and the door are not connected and that has a rotating shaft extending in the horizontal direction;

a knob portion that is displaceable, by rotating around the rotating shaft, between a door-locking position where the opening and closing of the door is restricted and a door-unlocking position where the opening and closing of the door is allowed; and a rotation stopper that determines the door-unlocking position of the knob portion, wherein the knob portion has an engaging groove in which the engaging pin moves due to the rotation of the knob portion, the engaging groove has an open end that faces in the horizontal direction when the knob portion is located at the door-unlocking position and through which the engaging pin is retracted or enters due to the opening or closing of the door, the engaging groove and the engaging pin become engaged with each other restricting the opening and closing of the door when the knob portion is displaced from the door-unlocking position to the door-locking position, and the engagement of the engaging groove and the engaging pin is released allowing for the opening and closing of the door when the knob portion is displaced from the door-locking position to the door-unlocking position, wherein, when the knob portion is located at the door-unlocking position, the rotation stopper positions the knob portion such that the engaging pin is located inside an extension range of the open end in the vertical direction, and wherein the engaging groove has a pushing surface that pushes, when the knob portion is displaced from the door-locking position to the door-unlocking position, the engaging pin such that a horizontal direction distance between the engaging pin and the rotating shaft obtained when the knob portion is located at the door-unlocking position becomes larger than the horizontal direction distance between the engaging pin and the rotating shaft obtained when the knob portion is located at the door-locking position.

2. The handle according to claim 1, wherein, when the engaging pin is pushed by the pushing surface, the freezer main unit and the door no longer come into contact with each other on the side of the respective side surfaces on which the main unit base and the door base are fixed.

3. The handle according to claim 1, wherein the pushing surface is located between the engaging pin and the rotating shaft and has a convex curved surface shape on an engaging pin side.

4. The handle according to claim 1, wherein one of the knob portion and the door base has a restricting member, and the other has a restricting member receiving portion, and wherein the restricting member is provided in a displaceable manner with respect to one of the members and can be switched between a first orientation for restricting the knob portion from being displaced to the door locking position by abutting on the restricting member receiving portion in a state where the knob portion is located at the door unlocking position and a second orientation for allowing the knob portion located at the door unlocking position to be displaced to the door locking position by being spaced apart from the restricting member receiving portion.

5. The handle according to claim 4, wherein the restricting member is at the first orientation in a state where the engaging pin is retracted from the engaging groove, and the orientation is switched to the second orientation when the engaging pin enters the engaging groove.

6. The handle according to claim 4, further comprising:

a biasing member that biases the restricting member to be at the first orientation, wherein the main unit base has a projecting portion that projects to a knob portion side, and wherein the projecting portion pushes the restricting member in a direction that is opposite to the biasing direction of the biasing member in accordance with approaching of the door to the freezer main unit so that the orientation of the restricting member is switched to the second orientation.

7. The handle according to claim 1, having a lock mechanism that fixes the knob portion to the door base.

8. The handle according to claim 7, wherein the lock mechanism has:

a convex portion that rotates along with the knob portion and abuts on the rotation stopper when the knob portion is located at the door-unlocking position and becomes spaced apart from the rotation stopper when the knob portion is located at the door-locking position, and a lock pin that restricts the displacement of the knob portion from the door-locking position to the door-unlocking position by entering a space between the convex portion and the rotation stopper while being in a state where the knob portion is located at the door-locking position.

9. The handle according to claim 1, wherein the door base has a first lock hole in which a lock for fixing the knob portion to the door base is mounted, wherein the knob portion has a second lock hole in which the lock is mounted together with the first lock hole, and wherein a positional relationship of the first lock hole and the second lock hole is defined such that, in a direction in which the door base and the knob portion are lined up, the first lock hole and the second lock hole overlap with each other when the knob portion is located at the door-locking position and the first lock hole and the second lock hole are shifted from each other when the knob portion is located at the door-unlocking position.

10. The handle according to claim 1, wherein the door base has a flat plate portion that abuts on a side surface of the door and a first insertion hole that is provided on the flat plate portion and into which a fastening member for fixing the door base to the door is inserted, wherein the knob portion has a second insertion hole into which the fastening member is inserted, and wherein a positional relationship of the first insertion hole and the second insertion hole is defined such that, in a direction in which the door, the door base, and the knob portion are lined up, the first insertion hole and the second insertion hole overlap with each other when the knob portion is located at the door-unlocking position and the first insertion hole and the second insertion hole are shifted from each other when the knob portion is located at the door-locking position.

11. A freezer comprising:

a freezer main unit that has an opening;

a door that seals the opening in an openable and closable manner; and the handle according to claim 1.

* * * * *